United States Patent [19]

Uchikoba

[11] 3,955,325

[45] May 11, 1976

[54] ABRADING APPARATUS FOR THE HOUSING OF A ROTARY ENGINE

[75] Inventor: Hatsuo Uchikoba, Kagoshima, Japan

[73] Assignee: Sayoko Uchikoba, Kagoshima, Japan

[22] Filed: May 15, 1975

[21] Appl. No.: 577,591

[30] Foreign Application Priority Data

Dec. 20, 1974 Japan ..... 49-146523

[52] U.S. Cl. ..... 51/90; 51/245; 51/DIG. 32

[51] Int. Cl.[2] ..... B24B 19/08

[58] Field of Search ..... 51/90, 241 R, 241 S, 51/241 B, 245, DIG. 32; 90/11 B, 12 R, 15

[56] References Cited

UNITED STATES PATENTS

| | | | |
|---|---|---|---|
| 3,548,548 | 12/1970 | Held | 51/90 |
| 3,851,422 | 12/1974 | Dojyo | 51/DIG. 32 |
| 3,886,689 | 6/1975 | Yoshimo | 51/90 X |

FOREIGN PATENTS OR APPLICATIONS

| | | | |
|---|---|---|---|
| 957,922 | 5/1964 | United Kingdom | 51/DIG. 32 |

*Primary Examiner*—Al Lawrence Smith
*Assistant Examiner*—Nicholas P. Godici
*Attorney, Agent, or Firm*—Karl W. Flocks

[57] ABSTRACT

An abrading apparatus for the housing of a rotary engine formed therein a cavity in which a rotor piston is adapted to revolve while being maintained in sliding contact with the inner peripheral wall of the housing. The abrading apparatus comprises rotatable cutters mounted at each one of the vertexes of the rotatable support member, a first drive shaft mounting thereon an eccentric cam for causing the support member to revolve along the predetermined path, and a second drive shaft mounted for rotation about the same center axis of rotation of the first drive shaft for causing the cutters to rotate.

1 Claim, 12 Drawing Figures

ABRADING APPARATUS FOR THE HOUSING OF A ROTARY ENGINE

This invention relates to apparatus for effecting abrading of the housing of a rotary engine, and more particularly it is concerned with an abrading apparatus adapted for effecting abrading of the housing of a rotary engine of the type in which the sliding surface on the edge portion is arcuate in cross-section.

This invention has for its object the provision of an abrading apparatus which enables to accurately and readily effect abrading of the inner peripheral surface of the housing of a rotary engine.

According to the invention, there is provided an abrading apparatus comprising a cutter support member formed therein with a plurality of vertexes and adapted to revolve along a predetermined path in the cavity of the housing, rotatable cutters each mounted at one of the vertexes of the cutter support member and adapted to effect abrading of the sliding surface on the edge portion or inner periphery of the housing, a first drive shaft mounting thereon an eccentric cam for causing the cutter support member to revolve along the predetermined path, and a second drive shaft mounted for rotation about the same center axis of rotation as the first drive shaft for causing the cutters to rotate.

Additional and other objects and features of the invention will become evident from the description set forth hereinafter when considered in conjunction with the accompanying drawings, in which.

Figure 1:
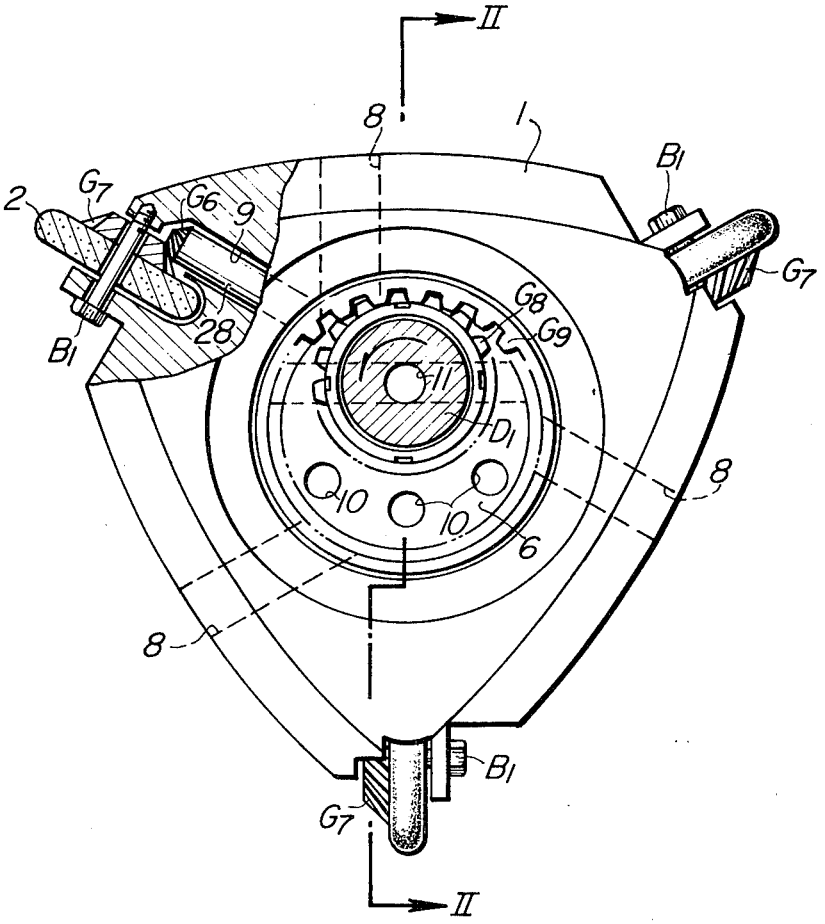
FIG. 1 is a front view, partly shown in section, of the essential portion of the abrading apparatus for the housing of a rotary engine according to the invention.

The invention will now be described with reference to a preferred embodiment shown in the drawings. The embodiment shown is adapted to effect grinding of the wall of a cavity 31 of a housing 30 for a rotary engine. The housing 30 consists of two half-portions 32 and 33 which are combined to define therebetween the cavity 31 in which a rotor piston (not shown) having three vertexes as described in Japanese Pat. Publication No. 37768/74 is adapted to revolve along a predetermined path while being maintained in sliding contact with the wall of the cavity 31. Inner peripheries 34 and 35 of the half-portions 32 and 33 respectively cooperate with each other to provide a sliding surface of the arcuate cross-section in the edge portion of the housing 30.

The abrading apparatus according to the invention comprises a rotatable cutter support member 1 which is formed therein with three vertexes and which is substantially similar in construction to the rotor piston of the rotary engine. The cutter support member 1 has mounted at each vertex a rotatable circular grinder or cutter 2 which is secured to the cutter support member 1 by a bolt $B_1$ for effecting abrading of the inner peripheries 34 and 35 of the housing 30. Edges 12 of the cutter support member 1 except for the portions in the vicinity of the vertexes are arcuate in cross-section as clearly shown in FIG. 2.

The cutter support member 1 is formed in its central portion with a bore 40 which is contiguous at one side thereof with a first enlarged bore 41 which in turn is contiguous with a second enlarged bore 42.

Figure 2:
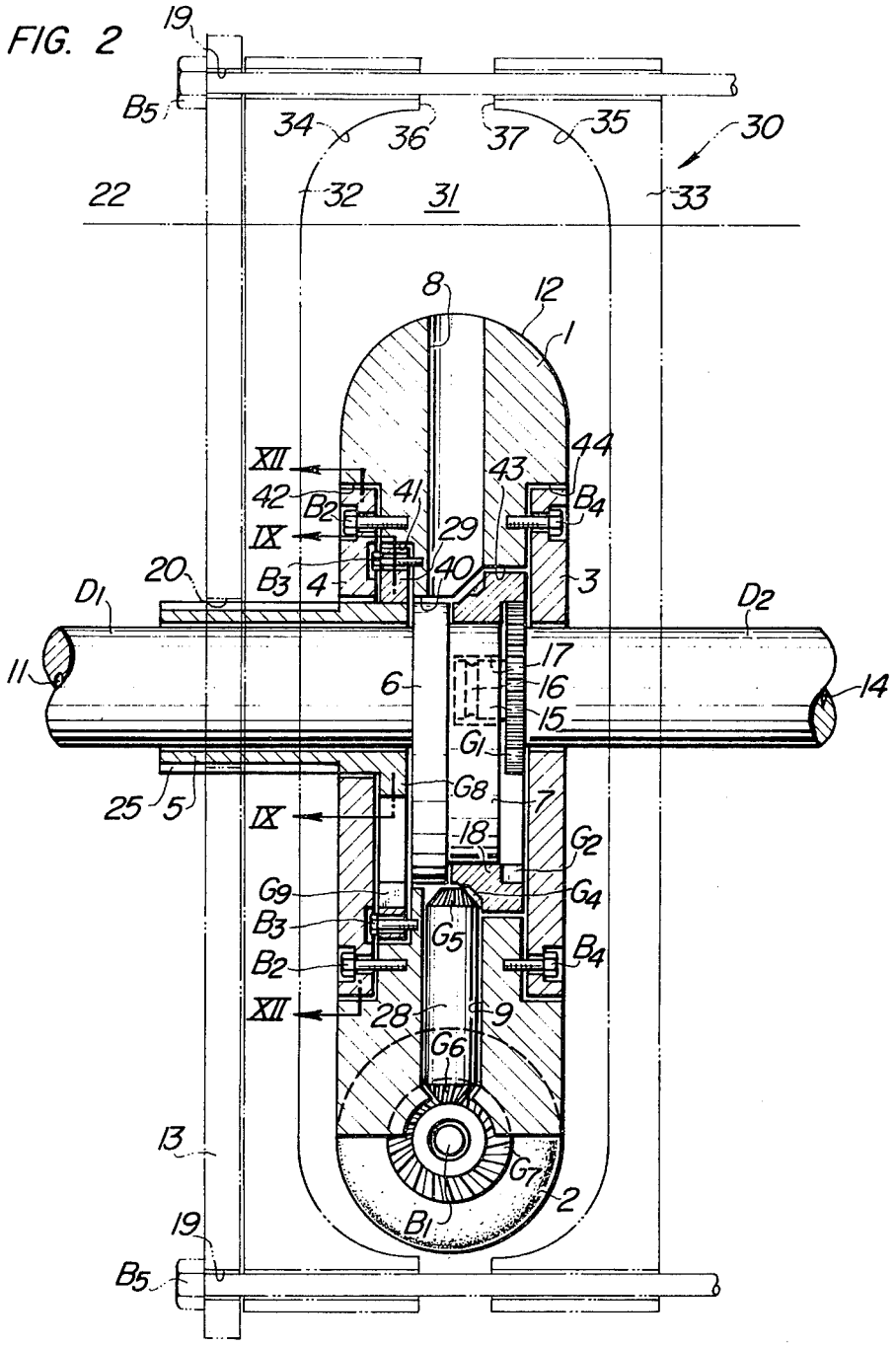
FIG. 2 is an enlarged sectional view taken along the line II—II of FIG. 1.
Figure 3:
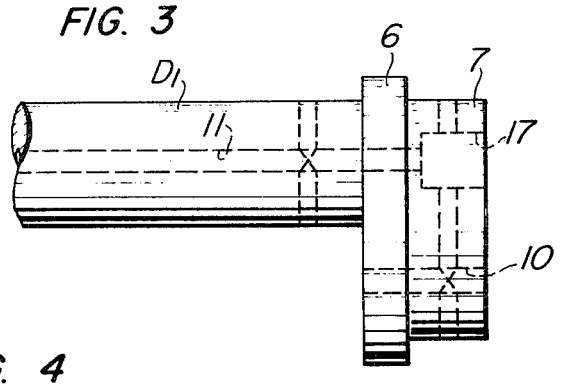
FIG. 3 is a side view of the first drive shaft shown in FIG. 2.
Figure 4:
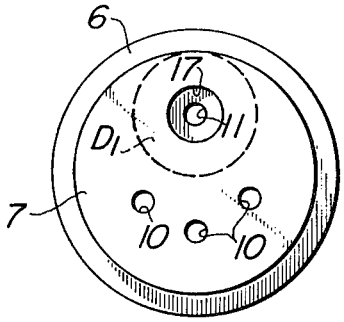
FIG. 4 is an end view of the first drive shaft shown in FIG. 3.

The center bore 40 formed in the cutter support member 1 has fitted therein a first eccentric cam 6 which is located near one end portion of a first drive shaft $D_1$ as shown in FIG. 2, FIG. 3 and FIG. 4. The first drive shaft $D_1$ is adapted to cause the cutter support member 1 to revolve along a predetermined path in the cavity 31.

The center bore 40 is contiguous at the other side thereof with a third enlarged bore 43 and a fourth enlarged bore 44. The third enlarged bore 43 has fitted therein a ring 18 which receives therein, as subsequently to be described, a second eccentric cam 7 formed at the outermost end of the first drive shaft $D_1$.

Figure 6:
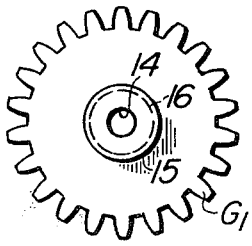
FIG. 6 is an end view of the second drive shaft shown in FIG. 5.
Figure 5:
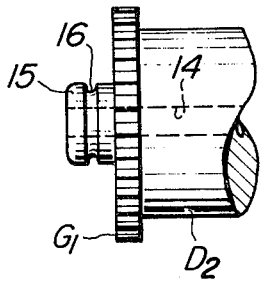
FIG. 5 is a side view of the second drive shaft shown in FIG. 2.

A second drive shaft $D_2$ adapted to cause the cutter 2 to rotate is formed, as shown in detail in FIG. 5 and FIG. 6, with a gear $G_1$ and an axial projection 15 which is formed thereon with a peripherally disposed oil groove 16. The projection 15 is received in an axial recess 17 formed at the end portion of the first drive shaft $D_1$. By this arrangement, the first drive shaft $D_1$ and second drive shaft $D_2$ have the same axis of rotation and are capable of rotating at different rates.

The ring 18 which is formed therein with an internal gear $G_2$ adapted to mesh with the gear $G_1$ formed in the second drive shaft $D_2$ and formed with skew bevel gears $G_4$ each adapted to mesh with a skew bevel gear $G_5$ formed at one end of each stub shaft 28 presently to be described, is fitted in the third enlarged bore 43 formed in the cutter support member 1. The aforesaid second eccentric cam 7 is fitted in the ring 18.

The cutter support member 1 is formed therein with bores 9 each receive therein one of the stub shafts 28 in such a manner that the skew bevel gear $G_5$ formed at one end of each stub shaft 28 meshes with the skew bevel gear $G_4$ formed in the ring 18 as aforementioned while a skew bevel gear $G_6$ formed at the other end of each stub shaft 28 meshes with a skew bevel gear $G_7$ formed at one side of each of the cutters 2.

By this arrangement, rotation of the second drive shaft $D_2$ is transmitted to the cutters 2 through the ring 18 and stub shafts 28.

In the drawings, the numeral 8 refers to oil ducts formed in the cutter support member 1 which are maintained in communication with the bores 9 for receiving therein the stub shafts 28. The numerals 10, 11 and 14 refer to oil ducts formed in the first drive shaft $D_1$ and second drive shaft $D_2$ respectively.

Figure 7:
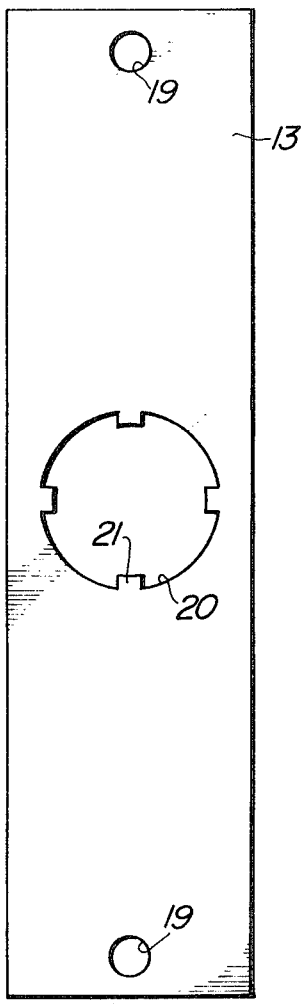
FIG. 7 is a plan view of the fixing plate shown in FIG. 2.
Figure 8:
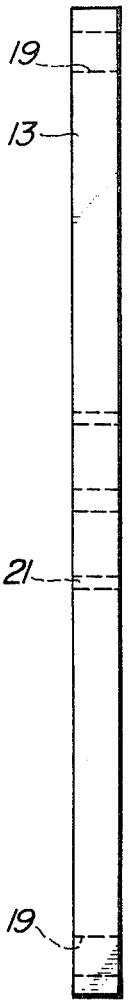
FIG. 8 is a side view of the fixing plate shown in FIG. 7.

The abrading apparatus according to the invention is constructed as aforementioned. In effecting abrading of the inner peripheries 34 and 35 of the half-portions 32 and 33 of the housing 30 by the aforesaid abrading apparatus, the fixing plate 13 is first positioned with respect to the housing half-portion 32 by means of bolts $B_5$. As shown in detail in FIG. 7 and FIG. 8, the fixing plate 13, which is rectangular in shape and greater in size than the housing 30, is formed therein with a central aperture 20 formed therein with four inwardly oriented projections 21 and with holes 19 for receiving therein the bolts $B_5$ for securing the fixing plate 13 to the housing 30.

Figure 9:
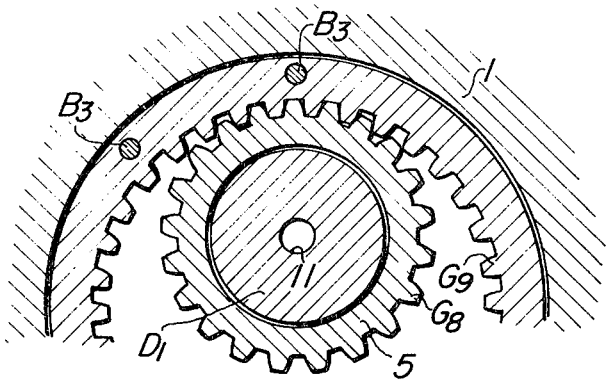
FIG. 9 is a sectional view taken along the line IX—IX of FIG. 2.

Then, the stub shafts 28 are inserted in the respective bores 9 formed in the cutter support member 1, and the first drive shaft $D_1$ is positioned with respect to the cutter support member 1 such that the first eccentric cam 6 is fitted in the central bore 40. A gear wheel 29 formed therein with an internal gear $G_9$ is inserted in the first enlarged bore 41 of the cutter support member 1 and secured in place by bolts $B_3$. A fixed gear shaft 5 formed therein with a gear $G_8$ is fitted over the first drive shaft $D_1$ in such a manner that the gear $G_8$ is brought into meshing engagement with the internal gear $G_9$ of the gear wheel 29 as shown in detail in FIG. 9.

Figure 10:
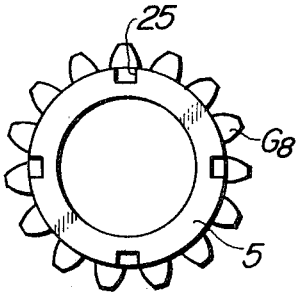
FIG. 10 is an end view of the fixed gear shaft shown in FIG. 2.
Figure 11:
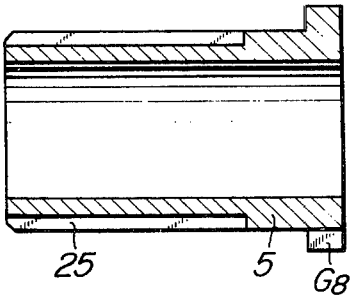
FIG. 11 is a longitudinal sectional view of the fixed gear shaft shown in FIG. 10.

As shown in detail in FIG. 10 and FIG. 11, the fixed gear shaft 5 is formed therein with a hollow cylindrical portion which receives the first drive shaft $D_1$ therein. The hollow shaft 5 has at one end thereof the gear $G_8$ which meshes with the internal gear $G_9$ of the gear wheel 29, and is formed on its outer periphery with longitudinal grooves 25 which each receive therein one of the inwardly oriented projections 21 formed in the fixing plate 13.

Figure 12:
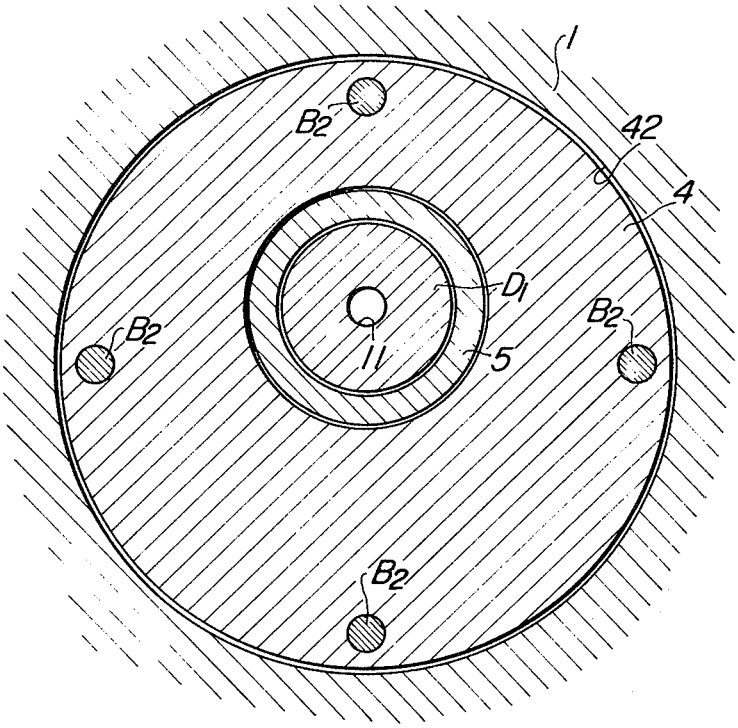
FIG. 12 is a sectional view taken along the line XII—XII of FIG. 2.

In order to position the cutter support member 1 with respect to the fixed gear shaft 5, a cover 4 is fitted in the second enlarged bore 42 and secured in place by bolts $B_2$ as shown in FIG. 2 and FIG. 12.

Thus, rotation of the first drive shaft $D_1$ causes the cutter support member 1 to revolve along an epitrochoid base line 22 in the cavity 31.

Then, the ring 18 is fitted in the third enlarged bore 43 located opposite the first enlarged bore 41 with respect to the central bore 40 of the cutter support member 1, and the skew bevel gears $G_4$ of the ring 18 are brought into meshing engagement with the respective skew bevel gears $G_5$ of the stub shafts 28. By inserting the projection 15 of the second drive shaft $D_2$ in the axial recess 17 of the first drive shaft $D_1$, the gear $G_1$ formed in the second drive shaft $D_2$ is brought into meshing engagement with the internal gear $G_2$ of the ring 18. In order to preclude dislodging of the ring 18 and second drive shaft $D_2$, a cover 3 is inserted in a fourth enlarged bore 44 and secured in place by bolts $B_4$.

Thus, rotation of the second drive shaft $D_2$ causes the cutters 2 to rotate.

The housing half-portion 33 is mounted on the fixing plate 13, and the first drive shaft $D_1$ and second drive shaft $D_2$ are rotated while the two housing half-portions 32 and 33 are held by the fixing plate 13. This initiates the abrading operation. As the abrading operation progresses, the fixing plate 13 to which the housing half-portion 32 is fixed gradually moves toward the center of the housing 30 as the inward projections 21 moves along the axial grooves 25 formed on the outer periphery of the fixed gear shaft 5. The abrading operation is completed when the two housing half-portions 32 and 33 come into engagement with each other at end surfaces 36 and 37 thereof.

In the embodiment shown and described hereinabove, the gear ratio of the gear $G_8$ of the fixed gear shaft 5 to the internal gear $G_9$ of the gear wheel 29 fixed to the cutter support member 1 is set at 2 : 3 and the rotational speed ratio of the cutter support member 1 to the first drive shaft $D_1$ is set at 1 : 3. It is to be understood, however, that the gear ratio of the gear $G_1$ provided at the second drive shaft $D_2$ to the internal gear $G_2$ of the ring 18 can be set at any value as desired in accordance with the desired number of revolutions of each cutter 2.

From the foregoing description, it will be appreciated that, with the abrading apparatus according to the invention, it is possible to effect abrading of the inner periphery of the housing of a rotary engine with high accuracy and precision when the housing consists of two half-portions. An added advantage offered by the invention is that it is possible to render the housing free from the drawback of the two half-portions of the housing being inaccurately jointed and forming an offset in the wall, thereby eliminating leaks of gas.

What I claim is:

1. An abrading apparatus for the housing of a rotary engine formed therein with a cavity in which a rotor piston having a plurality of vertexes is adapted to revolve along a predetermined path while being maintained in sliding contact with an inner peripheral wall of the housing said abrading apparatus being characterized by comprising a cutter support member (1) formed therein with a plurality of vertexes and adapted to revolve along a predetermined path in the cavity (31), cutters (2) each mounted at one of said vertexes of said cutter support member (1) to effect abrading of the inner peripheral wall (34, 35) of the housing (30), a first drive shaft ($D_1$) mounting thereon an eccentric cam (6) for causing said cutter support member (1) to revolve along said predetermined path, and a second drive shaft ($D_2$) mounted for rotation about the same center axis of rotation as the first drive shaft ($D_1$) for causing said cutters (2) to rotate.

* * * * *